United States Patent [19]

Södervall

[11] Patent Number: 4,896,785

[45] Date of Patent: Jan. 30, 1990

[54] COMBINATION CHEST FREEZER AND GLASS COVER

[75] Inventor: Sven-Erik Södervall, Edane, Sweden

[73] Assignee: Termofrost AB, Stockholm, Sweden

[21] Appl. No.: 243,137

[22] Filed: Sep. 9, 1988

Related U.S. Application Data

[62] Division of Ser. No. 17,618, Feb. 24, 1987, abandoned.

[30] Foreign Application Priority Data

Feb. 27, 1986 [SE] Sweden ..... 8600891

[51] Int. Cl.[4] ..... H05B 3/06

[52] U.S. Cl. ..... 220/82 R; 220/467; 220/377; 220/DIG. 8; 62/248; 312/116

[58] Field of Search ..... 220/82 R, 467, 377, 220/DIG. 8; 62/248; 312/116

[56] References Cited

U.S. PATENT DOCUMENTS

| | | | |
|---|---|---|---|
| 2,553,879 | 5/1951 | Stewart | 220/215 |
| 4,035,608 | 7/1977 | Stromquist | 62/248 |
| 4,206,615 | 6/1980 | Sobajima | 62/248 |
| 4,382,177 | 5/1983 | Heaney | 62/248 |
| 4,449,761 | 5/1984 | Davis | 62/252 |
| 4,584,236 | 4/1986 | Colmon et al. | 428/432 |
| 4,602,827 | 7/1986 | Casanova | 312/116 |

*Primary Examiner*—Stephen Marcus
*Assistant Examiner*—G. W. Reece
*Attorney, Agent, or Firm*—Nies, Webner, Kurz & Bergert

[57] ABSTRACT

A glass cover or lid for a chest freezer of the kind in which the goods contained therein are intended to be viewed through the glass cover and which chest is constructed so that a substantially stationary cushion of air can be generated immediately beneath the glass cover, preferably a chest which lacks devices for forcibly circulating air in the chest. The glass cover (1) includes a glass panel or two mutually parallel panels, and the side of the glass cover facing inwardly towards the interior of the chest is provided with a layer for reflecting infrared radiation.

4 Claims, 1 Drawing Sheet

COMBINATION CHEST FREEZER AND GLASS COVER

This application is a division of application Ser. No. 17,618, filed Feb. 24, 1987, now abandoned.

The present invention relates to a glass cover or lid for use with a chest freezer of the kind in which the goods contained therein are visible through the cover or lid of the chest. An example of this kind of chest freezer is a ice box in which the walls thereof are cooled and the upper side or top of which comprises essentially one or more raisable and lowerable glass covers.

One problem with chests of this kind is that the glass covers readily become fogged, so that the goods on display can no longer be seen.

In an attempt to reduce the exchange of heat between the interior of the chest and the surroundings, the glass cover is normally fabricated from double or triple glazed insulating glass panels.

In the case of a chest freezer, or ice box, which lacks forced air circulation and which is covered with a horizontal glass lid, the radiation properties of the glass surface facing the goods are of great significance. In the case of conventional glass, the emissivity may, for instance, be as high as $\epsilon=0.9$. This high emissivity results in a high exchange of radiation and consequently as a result of the insulation afforded by the double or triple glazing against convection through the glass lid or cover, the temperature of the glass surface which immediately faces the goods will be low. This means that this glass surface, the underglass, will become fogged when the lid is raised, due to moisture contained in the ambient air condensating on the cold underglass.

This problem is solved by means of the present invention, which relates to a glass cover or lid which will not become fogged with condensation and which will reduce the exchange of heat between the surroundings and the goods displayed in the chest.

Accordingly, the present invention relates to a glass cover or lid for a chest freezer of the kind in which the goods contained therein are intended to be seen through the glass cover and which is so constructed that a substantially stationary cushion of air can be generated immediately beneath the glass cover, preferably a chest which lacks means for forcibly circulating air in the chest, and is characterized in that the glass cover includes a glass sheet or two mutually parallel glass sheets of which the surface facing towards the interior of the chest is provided with a layer which is effective in reflecting infrared radiation.

Figure 1:
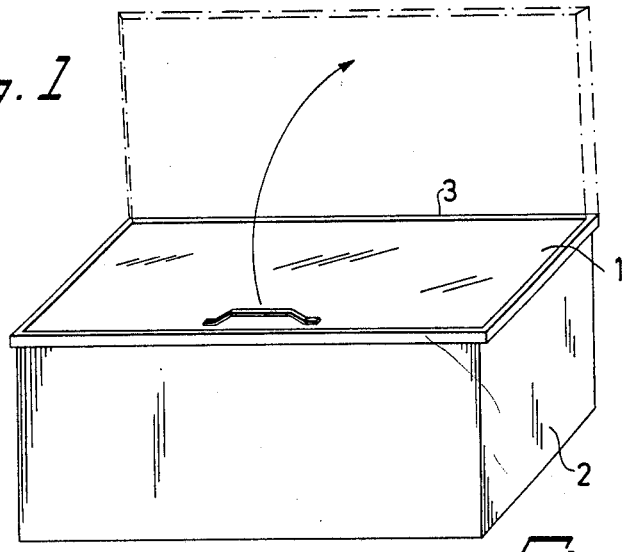
Figure 4:
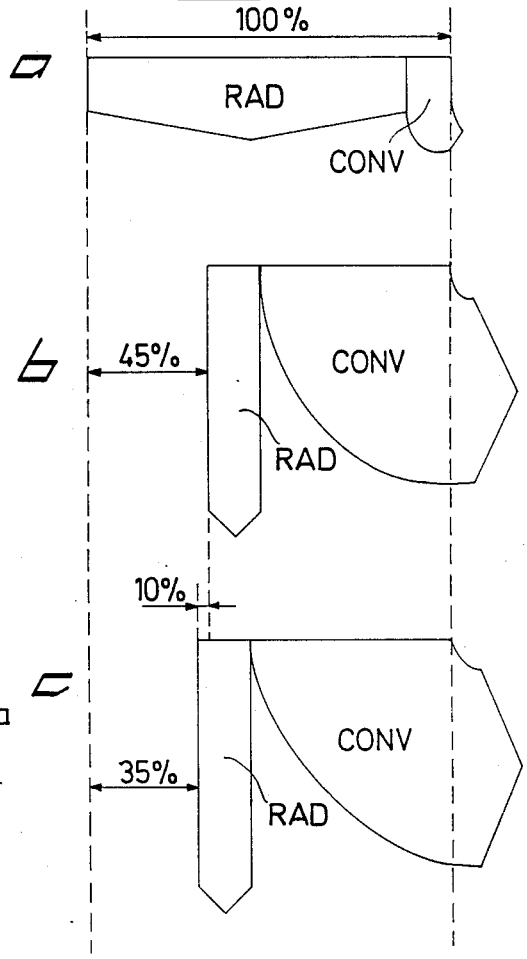
Figure 2:
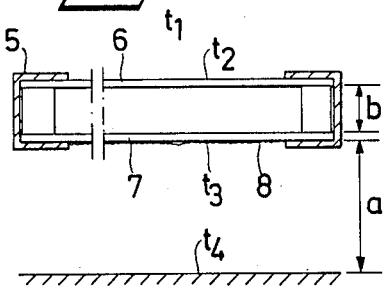
Figure 3:
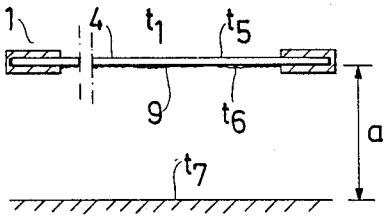

The invention will now be described in more detail with reference to exemplifying embodiments thereof illustrated in the accompanying drawings, and to an illustrative diagram, in which drawing FIG. 1 illustrates an upwardly raisable glass cover or lid according to the invention, hinged to a chest freezer, such as a ice box;

FIG. 2 is a sectional view of a glass cover or lid assembly according to a first embodiment of the invention;

FIG. 3 is a sectional view of a glass cover or lid assembly according to a second embodiment of the invention; and FIGS. 4*a*, 4*b* and 4*c* form a diagram in which 4*a* illustrates the flow of heat through a conventional double-glazed insulating panel fitted to a chest freezer; 4*b* illustrates the heat balance of the glass surface facing the goods when the glass cover is constructed in accordance with the FIG. 2 embodiment; and 4*c* illustrates the heat balance of the glass surface facing the goods when the glass cover is constructed in accordance with the FIG. 3 embodiment.

As will be understood, it is endeavoured to ensure that as little ambient heat as possible will enter the chest through the glass cover. To this end, the cover is fabricated from double or triple glazed glass insulating panels. In contradistinction to what was earlier believed, the main insulation against convection currents is not afforded by the air gaps in the insulating glass, but instead by a stationary air cushion located immediately beneath the glass cover or lid.

Due to heat seeping through the glass cover, the temperature of the underglass will be higher than the temperature prevailing in the chest and the temperature of the goods contained therein. Consequently, an air layer nearest the underglass will be warmer than the remainder of the air in the box, thereby generating said air cushion. The air cushion will be stable in those cases when the chest is not provided with forced air-circulation devices. It is essential that the chest is not provided with devices for circulating the air that is found in the chest region which is located immediately beneath the glass cover and which includes the air cushion. Circulation of air in the lower regions of the chest is of smaller or no importance. Thus, the chest shall be constructed so that a substantially stationary cushion of air can be generated and sustained immediately beneath the glass cover.

Furthermore, it is found that the largest proportion of heat transfer between the ambient surroundings and the goods contained in the chest in the case of chests, for example, equipped with double-glazed insulation panels is effected through radiation due to the high emissivity of conventional glass.

The present invention, however, is based on the concept of providing the undersurface of the glass cover facing the goods with a reflective layer so as to reduce the heat transfer between surroundings and goods without needing to employ multi-glazed insulating panels, while causing, at the same time, the surface of the underglass facing the goods to be heated to a temperature of such high magnitude as to prevent the cover from being fogged when raised in order to open the chest.

FIG. 1 illustrates a glass cover 1 of a chest freezer 2 of the type in which the goods contained therein are intended to be viewed through the glass cover and which lacks devices for forcibly circulating air in the chest. The chest, for example, may comprises a glass box whose inner walls are cooled. The invention primarily relates to an embodiment in which the glass cover 1 is hingedly connected to the chest along one of the edges 3 of the cover, so that the cover can be raised to a position shown in chain lines in FIG. 1.

In accordance with the invention the glass cover includes a glass panel 4, as illustrated in FIG. 3, or an insulating panel assembly 5 comprising two mutually parallel glass panels 6, 7, as illustrated in FIG. 2, where the surface of the glass cover facing the interior of the chest is provided with a layer 8, 9 which is effective in reflecting infrared radiation.

Preferably there are used toughened glass panels having a thickness of 3 mm. Various infrared reflecting layers are known to the art, and any suitable reflective layer can be used.

However, there is preferably used a layer which has an emissivity (ϵ) of about 0.05 to 0 2, preferably about 0.1. For example, a toughened-glass panel may be coated with a layer 8, 9 of stannic oxide in a known manner, where the stannic oxide forms an infrared reflecting layer having the aforesaid emissivity. When an insulating glass-panel assembly is used, the distance b between the glass-panels may be 16.5 mm.

The provision of an infrared reflecting layer on the glass surface facing the goods greatly reduces the exchange of radiation between the glass surface and the chest interior. The presence of the reflective layer causes the temperature of said glass surface to be increased, resulting in an increase in the exchange through convection between the glass surface and the air present, in comparison with a glass surface which is not provided with a reflective layer. In the main, however, this convection solely results in the stable air cushion being heated to a higher temperature. This will not affect the temperature of the goods contained in the chest, provided that the air forming the air cushion is not forced to circulate within the chest.

Tests have shown that when a chest freezer is fitted with a glass cover or lid constructed in accordance with the invention, the heat transfer between the surroundings and the interior of the chest and the goods contained therein is reduced by about 40% in comparison with a conventional cover comprising double-glazed insulating panels. Thus, when practicing the invention the exchange of heat with the surroundings is relatively low, while the aforesaid surface of the underglass is heated to a relatively high temperature in comparison with known glass covers or lids.

This lower heat exchange results in substantially lower operational costs in respect of chest freezers of this kind, such as a glass chest. The higher temperature of the undersurface of the glass cover, i.e. the aforesaid glass surface, affords the highly significant advantage that the undersurface will not become fogged when the cover is raised. Tests have shown that when practicing the present invention the temperature of this undersurface is, for instance, +11° C. to +17° C. when the temperature of the goods contained in the chest is −16° C. to −17° C. In the case of a conventional glass cover, the temperature of the undersurface may, for example, be as low as +3° C. At a temperature of +3° C., the cover will rapidly become fogged at normal ambient room temperatures with ambient air of normal humidity.

The fact as to whether condensation will form on the undersurface of the glass cover or not depends partly on the temperature of said undersurface and also on the prevailing dew point. Practical tests have shown that the undersurface of a glass cover constructed in accordance with the invention will remain free from condensation when the cover is raised, and therewith exposed to the ambient air, in the presence of relative air humidities which are normal in departmental-store environments.

As beforementioned, the aforesaid stable air cushion provides a significant insulating barrier with regard to convection. This circumstance is particularly utilized when practicing the aforementioned second embodiment of the invention. Because the glass cover of this second embodiment comprises solely a single glass panel 4 coated with an infrared reflecting layer 9, the glass panel 4 will be heated to a higher temperature than the bottom glass panel 7 when utilizing the first embodiment of the invention. Despite the higher temperature of the glass panel 4, however, only about 10% more heat will be transferred to the goods through convection than when using a double-glazed insulating panel assembly. This is due to the fact that the air cushion makes the transfer of heat by convection more difficult.

This insignificant increase in heat transfer through convection shall be viewed in the light of the considerable advantage afforded by the fact that when the glass cover includes solely one glass panel the undersurface of said panel has a temperature which is only from 3° C. to 4° C. lower than the temperature of the ambient air, which may be as high, for example, as +20° C. This means that the glass panel will remain free from condensation even when the store locality has a high relative humidity, for example 60% to 70%.

Thus, when the glass cover is constructed in accordance with the invention the undersurface of the cover is kept free from condensation and less heat is transferred from the surroundings to the goods contained in the chest than in the case of a conventional glass cover. Because the undersurface of the cover is kept free from condensation, it is not necessary to heat the glass cover electrically. It is necessary to heat conventional glass covers electrically in order to prevent the covers from becoming fogged with condensation. FIGS. 4*a*, 4*b* and 4*c* illustrate an example of the heat balances measured on the side of the glass cover facing the goods contained in the chest. FIG. 4*a* shows a 100% heat seepage when using a conventional double-glazed insulating panel. The heat seepage is distributed so that heat transfer through radiation (RAD) is about 90% and heat transfer through convection (CONV) is about 10%. A glass cover constructed in accordance with FIG. 2 gave rise to the heat balance illustrated in FIG. 4*b*. It will be seen from FIG. 4*b* that the amount of heat seeping into the chest was reduced by 45% and was changed so that the convection increased while the radiation drastically decreased. The reason for this increase in convection is because the lower glass 7 is much warmer than the lower glass of a conventional glass cover.

When applying a given cooling effect in a chest 2 and while using a conventional glass cover of the construction illustrated in FIG. 2 insofar as the cover lacked the infrared reflecting layer 8, at an ambient temperature of +19.5° C., the upper surface of the glass cover was found to have a temperature of +11.5° C., the undersurface of the glass cover was found to have a temperature of +4.5° C. and the temperature of the goods was measured at −11° C. The distance a between the undersurface of the cover and the goods was as small as 110 mm.

When using a glass cover constructed in accordance with FIG. 2, the corresponding temperatures were $t_1 = +19.5°$ C.; $t_2 = +15.5°$ C.; $t_3 = +11.5°$ C. and $t_4 = -17°$ C. The goods ($t_4$) were thus much colder than when a conventional glass cover was used, despite the fact that the temperature ($t_3$) of the undersurface of the glass cover was as high as +11.5° C.

A glass cover constructed in accordance with FIG. 3 resulted in the heat balance illustrated in FIG. 4*c*. It will be seen from FIG. 4*c* that the heat seepage was reduced by 35% compared with the use of a conventional glass cover. The increase of 10% in comparison with the use of the glass cover illustrated in FIG. 2 is the result of increased convection. As beforementioned, this increase in convection is very slight in view of the fact that the glass cover according to FIG. 3 solely comprises a single-glass panel.

When using a glass cover constructed in accordance with FIG. 3 the temperature $t_5 = +15.5°$ C., $t_6 = +15.5°$ C., $t_7 = -16.5°$ C. were obtained when the ambient temperature $t_1$ was 19.5° C. Thus, when using a glass cover comprising solely a single glass panel 4 there was obtained a temperature $t_6$ which was only 4° C. beneath the ambient temperature.

A comparison made between the temperatures obtained with a glass cover constructed in accordance with FIG. 2 and a glass cover constructed in accordance with FIG. 3 showed that with a glass cover that comprises solely a single glass panel a much higher temperature is obtained on the undersurface of the glass cover without appreciably increasing the temperature $t_4$; $t_7$ of the goods contained in the chest.

It will be readily seen that the aforedescribed invention provides an important step forward in this particular art.

Thus, the problem discussed in the introduction is resolved by means of the present invention, while at the same time achieving a reduction in the transfer of heat from the surroundings to the goods contained in the chest freezer. Furthermore, a glass cover that comprises solely a single glass panel is cheaper to produce and lighter in weight than a conventional glass cover fabricated with a double glazed insulating panel.

Although the invention has been described in the aforegoing with reference to two mutually different exemplifying embodiments thereof, it will be understood that the invention is not restricted to these embodiments but that modifications can be made within the scope of the following claims.

I claim:

1. The combination of a chest freezer and a glass cover, the freezer being of the kind in which the goods contained in the chest are intended to be viewed through the glass cover, said chest freezer being void of devices for forcibly circulating air within the chest when the cover is closed, and said glass cover (1) being hinged to the chest (2) along one of the edges of said cover so that the cover is raised, to swing about the axis of the hinge, to be opened, characterized in that: said glass cover (1) is horizontal when in its closed position; said glass cover (1) consists solely of one glass pane (4), which is void of an electrically conductive coating for electric heating of the panel, and, on the side of the glass pane which faces the interior of the chest, the surface of the pane is provided with an infrared radiation reflecting layer (8) having an emissivity value not greater than 0.2 whereby a substantially stationary non-circulating cushion of air is generated in said chest immediately beneath the closed, horizontal glass cover.

2. The combination according to claim 1, characterized in that the reflecting layer (8; 9) has an emissivity within the range of about 0.05 to 0.2.

3. The combination according to claim 1, characterized in that the cover pane (4) is made of toughened glass.

4. The combination according to claim 2, wherein the reflecting layer (8; 9) has an emissivity of about 0.1.

* * * * *

UNITED STATES PATENT AND TRADEMARK OFFICE

CERTIFICATE OF CORRECTION

PATENT NO. : 4,896,785

DATED : January 30, 1990

INVENTOR(S) : SVEN-ERIK SODERVALL

It is certified that error appears in the above-identified patent and that said Letters Patent is hereby corrected as shown below:

IN THE SPECIFICATION:

Column 3, line 2, change "0 2" to --0'2--.

Signed and Sealed this

Twelfth Day of February, 1991

*Attest:*

HARRY F. MANBECK, JR.

*Attesting Officer*

*Commissioner of Patents and Trademarks*